US007185406B2

(12) United States Patent
Wimmer

(10) Patent No.: US 7,185,406 B2
(45) Date of Patent: Mar. 6, 2007

(54) DEVICE AND METHOD FOR TREATING AN ELONGATED MEDIUM

(75) Inventor: Josef Wimmer, Töging am Inn (DE)

(73) Assignee: Belmont Textile Machinery Company, Mount Holly, NC (US)

( * ) Notice: Subject to any disclaimer, the term of this patent is extended or adjusted under 35 U.S.C. 154(b) by 404 days.

(21) Appl. No.: 10/654,647

(22) Filed: Sep. 3, 2003

(65) Prior Publication Data

US 2005/0044669 A1 Mar. 3, 2005

(30) Foreign Application Priority Data

Aug. 28, 2003 (EP) ..... 03019463

(51) Int. Cl.
*D02G 1/20* (2006.01)

(52) U.S. Cl. ..... 28/258; 28/220; 28/221; 28/265

(58) Field of Classification Search ..... 28/263, 28/270, 264, 265, 266, 267, 269, 220, 221, 28/258, 268, 247, 252; 264/168, 282, 285, 264/286

See application file for complete search history.

(56) References Cited

U.S. PATENT DOCUMENTS

| | | | | | |
|---|---|---|---|---|---|
| 2,326,174 | A | * | 8/1943 | Rutishauser | 264/143 |
| 3,000,060 | A | * | 9/1961 | Shattuck et al. | 28/265 |
| 3,137,055 | A | | 6/1964 | Rainard | |
| 3,140,525 | A | * | 7/1964 | Lamb | 28/252 |
| 3,147,533 | A | * | 9/1964 | Baer | 28/258 |
| 3,180,003 | A | * | 4/1965 | Lamb | 28/258 |
| 3,234,625 | A | * | 2/1966 | Trifunovic et al. | 28/264 |
| 3,406,436 | A | * | 10/1968 | Clarke, Jr. | 28/250 |
| 3,570,084 | A | | 3/1971 | Stanley | |
| 3,679,533 | A | * | 7/1972 | Fukuda et al. | 28/263 |
| 3,722,042 | A | * | 3/1973 | Stanley et al. | 28/270 |
| 3,805,853 | A | * | 4/1974 | Gladu | 28/258 |
| 3,924,311 | A | * | 12/1975 | Stanley | 28/221 |
| 4,043,009 | A | * | 8/1977 | Stanley et al. | 28/221 |
| 4,299,015 | A | * | 11/1981 | Marcus et al. | 28/221 |
| 4,547,934 | A | | 10/1985 | Ford | |
| 4,807,337 | A | | 2/1989 | Fleissner | |
| 4,854,021 | A | | 8/1989 | Reinehr | |
| 5,074,016 | A | | 12/1991 | Meyer | |
| 5,419,023 | A | * | 5/1995 | Hawkins et al. | 28/267 |
| 5,771,674 | A | * | 6/1998 | Smith et al. | 57/284 |
| 6,385,827 | B1 | * | 5/2002 | Stewart et al. | 28/263 |

FOREIGN PATENT DOCUMENTS

| | | |
|---|---|---|
| CH | 31065 | 5/1904 |
| GB | 870250 | 6/1961 |
| GB | 1297340 | 11/1972 |

* cited by examiner

*Primary Examiner*—Amy B. Vanatta
(74) *Attorney, Agent, or Firm*—Adams Evans P.A.

(57) ABSTRACT

A device for treatment of an elongated medium with at least two first rotational bodies, which are pivoted around predefined rotational axes, whereby the rotational axes are essentially parallel to one another, with at least two second rotational bodies, which are pivoted around predefined rotational axes, a first treatment chamber, which is arranged in a conveying route of the elongated medium between the two first rotational bodies and the two second rotational bodies, and a second treatment chamber for the elongated medium, which is arranged in the conveying route of the elongated medium after the second two rotational bodies.

19 Claims, 4 Drawing Sheets

Figure 1:
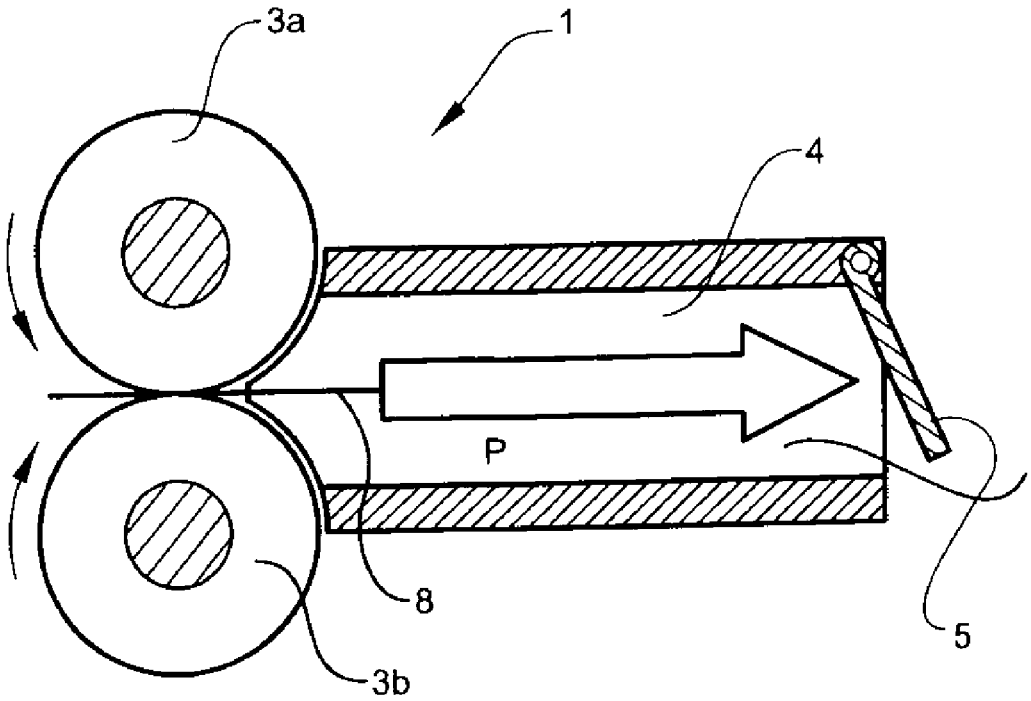
Fig. 1 Prior Art

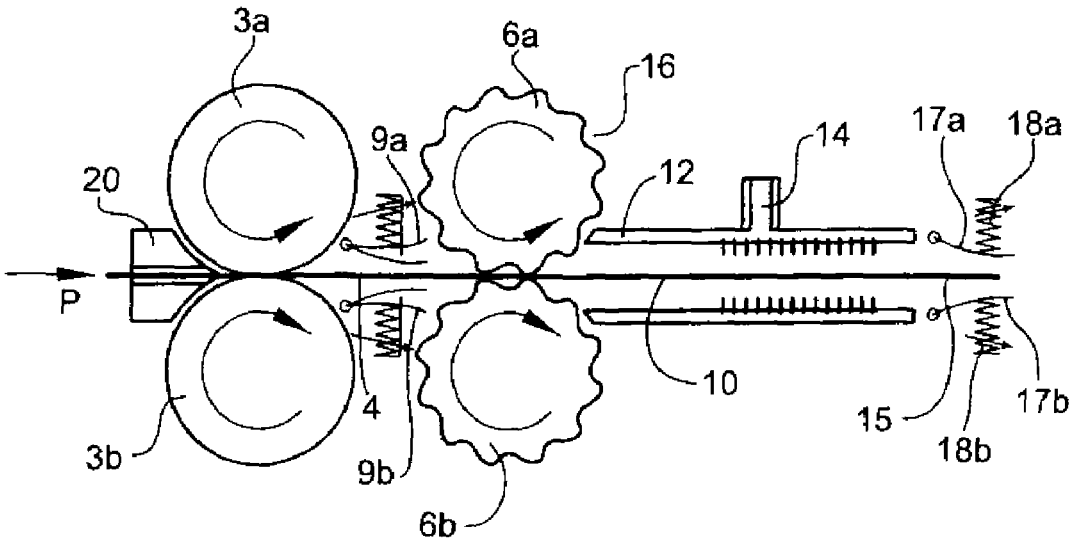
Fig. 3
Fig. 4
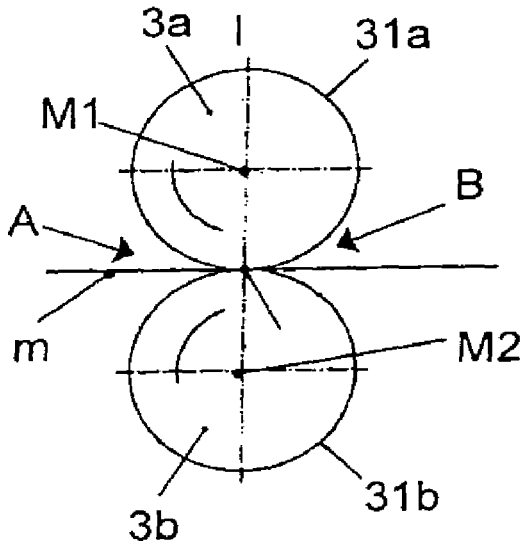
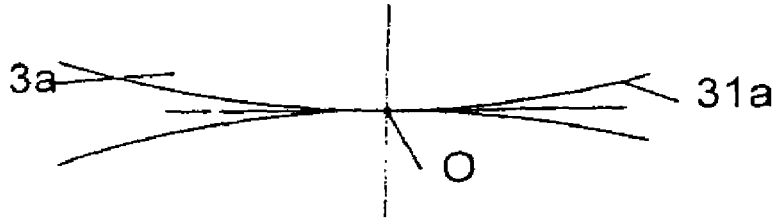
Fig. 5

Fig. 6
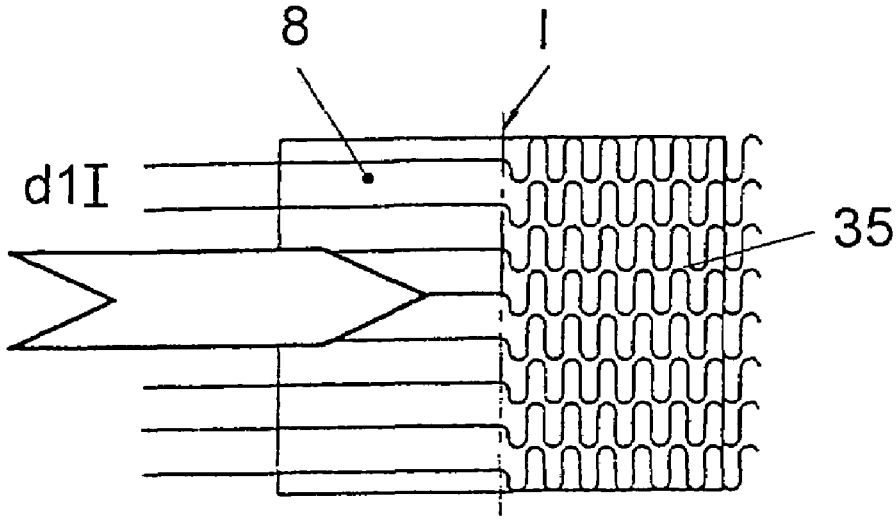
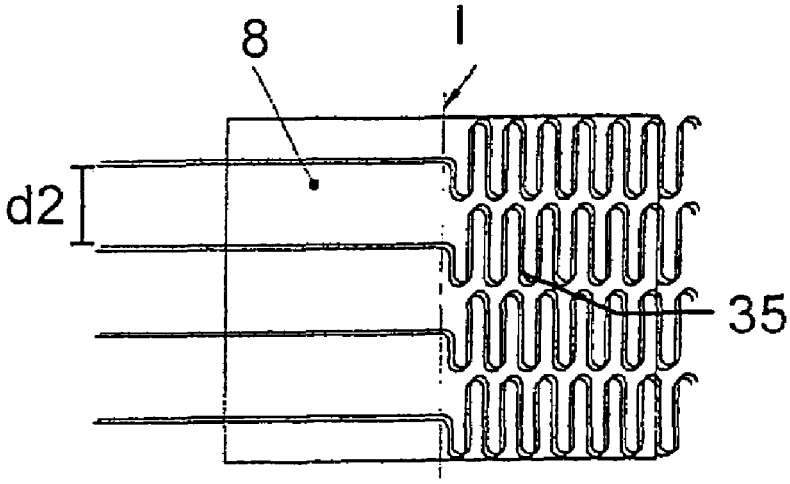
Fig. 7

Fig. 8
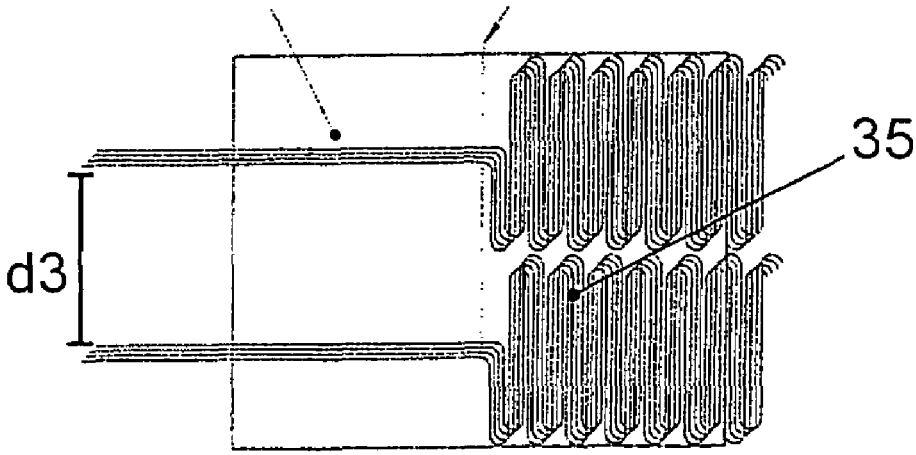
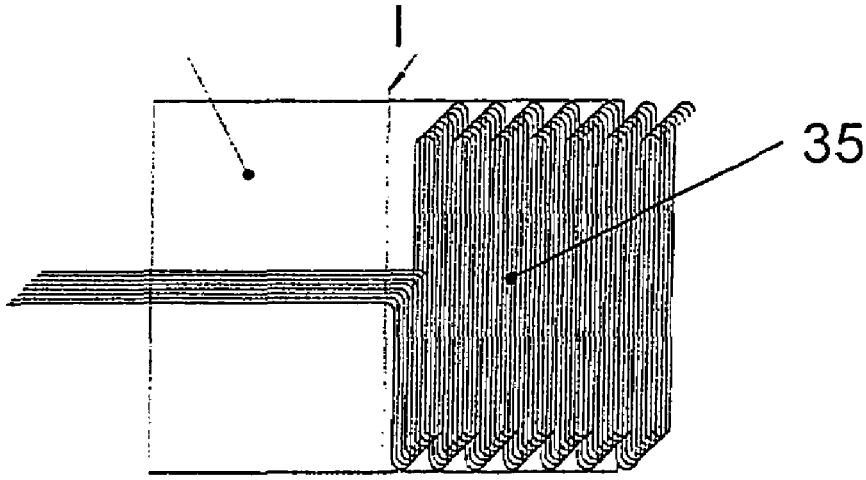
Fig. 9

DEVICE AND METHOD FOR TREATING AN ELONGATED MEDIUM

The present invention relates to a device and a method for treating an elongated medium. The method and the device are described in reference to non-metallic media and in particular in reference to textile yarns, however it is noted that other fields of application are also conceivable.

Different kinds of carpets are offered on the market. A broad spectrum of carpet types are available, for example "Saxony", "Textured" or "Frieze" carpet types. To show the different carpet types, in different manufacturing stages influence is exercised on the method or the production. Introducing additional processing steps is also known from the state of the art, as for example in the case of frieze or textured yarn.

To be able to generate the appearance of frieze or textured yarns, the yarn is mechanically shaped, in particular, but not exclusively with additional heat and moisture. In the process, so-called frieze or stuffer boxes are used.

The current methods known in the state of the art all follow essentially the same principle. In the process, a bundle of yarn made of several threads is pressed into a well by means of two conveyor rollers. By means of the pressing a pressure increase is caused and with it an increase of the frieze character.

On the other hand, this pressure increase is connected with considerable disadvantages. Since, as noted, the transport of the yarn is assumed by two rollers, an increasing pressure of the compressed yarn also occurs on the two conveyor rollers. Since on the other hand the conveyor rollers run with a circumferential speed of up to 600 m/minute, a rubbing of the compressed yarn on the rollers can occur. This in turn causes shiners, which are to be seen as a distinct quality defect.

An additional disadvantage lies in the fact that as a result of the increased pressure of the yarn on the pair of rollers the operating safety of the system is quite severely reduced. In the process the compressed yarn is pressed so strongly against the rollers that individual fibers can become creased from hanging wrong and in this way a blocking of the entire system can occur or single threads can tear.

This problem is countered in the state of the art by two different measures. On the one hand the possible conveyor speed of 600 m/minute can be distinctly reduced (by approx. 40%), which however in turn increases the production costs. Another possibility lies in reducing the pressure in the compression chamber. In this way, however, the degree of the frieze character is also reduced.

One object of the present invention lies in avoiding the above described disadvantages, without simultaneously having to resort to the above described, production cost increasing measures.

A further object of the invention lies in achieving that the frieze character can be varied in an enlarged area compared as opposed to the state of the art.

These objects are solved by the invention by means of a device according to claim 1. Advantageous embodiments are the subject matter of the dependent claims.

The invention's device for treating an elongated medium has at least two first rotational bodies, which are pivotally attached around the predefined rotational axes, whereby the rotational axes are preferably essentially parallel to one another, next to this there are at least two second rotational bodies provided, which are pivotally attached around the predefined rotational axes.

Further, a first treatment chamber is provided for the elongated medium, which is arranged on a conveying route of the elongated medium between the two first rotational bodies and the two second rotational bodies. In addition, a second treatment chamber is provided for the elongated medium, which is arranged on the conveying route of the elongated medium in particular after the two second rotational bodies.

In the case of the elongated medium, as noted above, it is preferably a yarn, which for example can be used in the manufacturing of carpets.

In the process, the invention's device can be used to process natural fiber yarns or artificial fiber yarns. The natural fibers are selected from a group of natural fibers which contains wool, cotton, flax, linen and the like. The artificial fibers are selected from a group of artificial fibers containing polyamide 6, polyester, polypropylene, acrylic and the like.

The device can be used in particular but not exclusively to process staple fiber yarns or filament yarns as well as spun, calibrated or twist yarns.

By treatment every physical or chemical influence on the long-stretched medium is understood, in particular heat treatment, treatment by means of fluid and/or gaseous media, in particular but not exclusively steam or saturated steam, cold treatment, pressure treatment, treatment by means of twisting and the like.

Also an unraveling of a yarn into individual threads is understood as treatment as defined by the present invention.

By treatment chamber a defined area or a defined volume is understood, in which a treatment of the elongated medium takes place, such as for example a treatment by means of water or saturated steam, by means of heat, pressure and the like.

By conveying route of the medium a predefined route or path is understood, which the elongated medium, that is, in particular but not exclusively the yarn takes from its entry into the device until its exit from the device.

In a preferred embodiment at least the first treatment chamber is variable with regard to its volume. With this it is for example possible to exert influence on the mean cross section of the space or also its length. By variable it is further understood that the space can be subdivided into several subspaces by means of further devices.

In a further preferred embodiment, along with the at least two first rotational bodies and the at least two second rotational bodies, which in the following will also be termed first and second roller pair, further rotational body pairs can be provided along the conveying route of the elongated medium. Further, there can also be more than two treatment chambers.

In a further preferred embodiment at least one rotational body has essentially cylindrical surface features. In particular a rotational body of the two first rotational bodies is involved. The first rotational body has a trochoid or cylindrical structure or an essentially circular cross section. The cross section can also deviate from this and for example be elliptical or similar. The rotational body can also be cone-shaped in design.

In a further preferred embodiment the two first rotational bodies have essentially the same diameter. In a further embodiment the two first rotational bodies have different diameters.

In a further preferred embodiment the rotational axis of at least a first rotational body, preferably of both first rotational bodies, is essentially its or their center axle. This means that in the case of a rotation of the first rotational body essentially no eccentricities occur.

In a further preferred embodiment at least one second rotational body, preferably both second rotational bodies, has a form deviating from the ideal form of a cylinder. It can be deviating forms with regard to the cylindrical surface, such as recesses, synclines, projections and the like. Preferably at least one second rotational body has recesses, which essentially run parallel to the rotational axis of the second rotational body. In the process the recesses are preferably essentially constant over the length of the second rotational body, however, it is also possible to vary the depth or width of these recesses along the length of the second rotational body.

In a further preferred embodiment the rotational axis corresponds at least to one second rotational body, preferably both second rotational bodies, essentially the center line of a cylinder in disregard of the deviations. The second rotational body in particular, but not exclusively, is designed in such a way that it is provided in cross section point symmetric to a central point, through which the rotational axis runs.

In a further preferred embodiment at least one first rotational body is driven. In a further preferred embodiment at least one second rotational body is driven. However, it is also possible to drive both first and both second rotational bodies, whereby the drives can be coupled with each other or independent from one another.

In the process it is preferable that the circumferential speed of at least one second rotational body be lower than the circumferential speed of at least one first rotational body.

Preferably the circumferential speed of at least one second rotational body is between 1/40 and 1/2, preferably between 1/20 and 1/4, and particularly preferable about 1/10 of the circumferential speed of at least one first rotational body.

In a further preferred embodiment at least the second treatment chamber has feed mechanisms for a fluid and/or gaseous medium, in particular, but not exclusively, steam or saturated steam. The steam or saturated steam can be fed under a predefined pressure in a second treatment chamber.

In a further preferred embodiment a sorting device for the elongated medium is provided on the conveying route in front of the two first rotational bodies. Preferably this sorting device has separating elements that are selected from a group of separating elements which have combs, eyelets, boreholes and the like. This sorting device is used to unravel (separate) a complete yarn into a maximum of its individual threads or also into groups of several threads.

In a further preferred embodiment a contraction device for the elongated medium is provided on the conveying route of the elongated medium after the second treatment chamber. In this contraction device a pressure increase can be effected on the elongated medium. In a further preferred embodiment a heating space is provided on the conveying route of the elongated medium after the second treatment chamber. In this space, for example, a heat setting of the long-stretched medium, that is the yarn, can be performed.

In a further preferred embodiment at least the two first rotational bodies come into contact with each other along a predefined straight line, which is essentially determined by the intersection line of a plane, which contains both rotational axes, and a common plane, which is determined at the two rotational bodies. This will be explained more precisely below with reference to the figures.

In a further preferred embodiment the circumferential speed of at least one first rotational body is between 200 m/Minute and 1000 m/Minute, preferably between 400 m/Minute and 900 m/Min., and particularly preferably between 550 and 650 m/Minute. In the process, influence can be exerted on the circumferential speed on the one hand by means of changing the diameter of the rotational body and on the other hand by means of increasing the rotational velocity/angular velocity.

In a further preferred embodiment at least one treatment chamber has a closing device, in particular, but not exclusively, a shutter.

In a further preferred embodiment at least one treatment chamber is sealed off from the surroundings. This means that within the treatment chamber a temperature, pressure or similar level is selected, which differs from the surroundings, whereby essentially no equalization can take place by the corresponding ambient parameters.

In a further preferred embodiment the exit of at least one treatment chamber tapers in the conveying route of the elongated medium. Preferably the taper of the exit is variable and a change of the taper can occur automatically by means of a control device.

In a further preferred embodiment at least the second treatment chamber has flow facilities for a fluid and/or gaseous medium, such as in particular, but not exclusively, steam or saturated steam. For example, porous wall sections or the like can be used.

The invention is further geared toward a method for treatment of an elongated medium, whereby in a first step an elongated medium is passed through between two first rotational bodies, which are pivotally attached around predefined rotational axes. In a further treatment step the elongated medium is passed through a first treatment chamber and in a further step of the method is passed through two second rotational bodies, which are pivotally attached in predefined rotational axes. In a further step the elongated medium is passed through a second treatment chamber.

Preferably a heat setting of the elongated ware takes place in a conveying route of the elongated medium particularly subsequent to the second treatment chamber.

Additionally, the elongated medium is preferably divided into several components, in particular by means of a separation or sorting device. The several components include the individual threads of the yarn, but also include several more or less strong or thick bundles of individual threads.

However, preferably the elongated medium is essentially immediately divided into several components.

Further, the individual components are essentially to be arranged preferably uniformly and/or in predefined distribution over the longitudinal direction of the two first rotational bodies or of their essentially cylindrical surface.

Further, the volume of the first treatment chamber is preferably set automatically.

Further advantages and embodiments of the invention's device result from the drawings.

Figure 2:
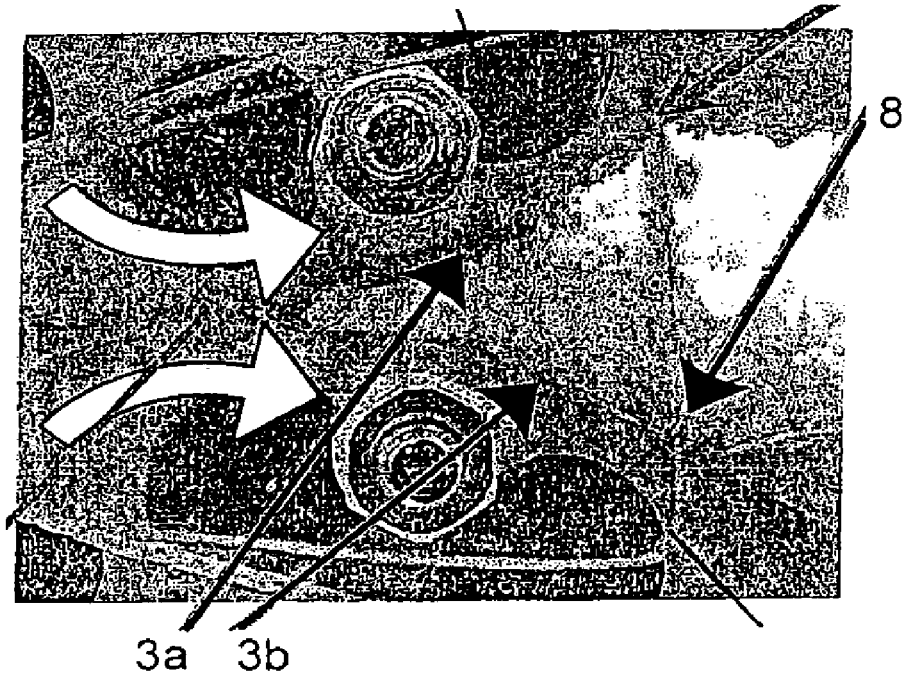

The drawings show the following:

FIG. 1 a diagrammatic representation of a device for treatment of an elongated medium according to the state of the art;

FIG. 2 a representation for the illustration of the disadvantages occurring with the state of the art;

FIG. 3 a device of the invention for treatment of an elongated medium;

FIG. 4 a detailed representation of two first rotational bodies;

FIG. 5 a representation for illustration of the feeding of the elongated medium through the first two rotational bodies;

FIG. 6 a representation for illustration of the distribution of the yarn on several components;

FIG. 7 a further representation of the distribution of the yarn, as in FIG. 6;

FIG. 8 a further representation of the distribution of the yarn, as in FIG. 6; and FIG. 9 a further distribution of the yarn, as in FIG. 6.

FIG. 1 shows a device for treatment of an elongated medium according to the state of the art. This has a first rotational body 3*a* and a second rotational body 3*b*, between which the elongated medium 8 is guided along the direction of the arrow P. Reference symbol 4 refers to a first treatment chamber, while reference symbol 5 refers to a cap arranged at the end on treatment chamber 4 in the conveying direction of the yarn.

FIG. 2 represents the problems occurring with the state of the art. Reference symbols 3*a* and 3*b* refer to the rotational bodies, between which the yarn is fed through. As can be seen from the figure, a knot has already formed here, caused by the back pressure or backward slip, said knot having the tendency to be pressed against rotational bodies 3*a* and 3*b*. In this way there can be, as initially mentioned, a rubbing of the yarn 8 on the rotational bodies 3*a* and 3*b*, thus resulting in shiners on the yarn. The danger also exists that the yarn will interlock in the roller and that this will finally result in a blocking of the entire system.

FIG. 3 shows a device in accordance with the invention for treatment of the elongated medium. In the following, instead of the elongated medium the term yarn will be used.

The invention's device for treating the yarn has two first rotational bodies 3*a* and 3*b*, through which the yarn runs along the direction of arrow P. The curved arrows within the rotational body indicate the directions of rotation of both rotational bodies. After passing through the two first rotational bodies the yarn arrives in a first treatment chamber 4. This first treatment chamber 4 has devices 9*a* and 9*b* for contraction of area of this space. This area contraction device 9*a* can be controlled or regulated in such a way that the cross section of the first treatment chamber or of the first channel 4 can be adapted to the yarn or quantity of the yarn passing through. For contraction of area in this embodiment spring elements with an adjustable elasticity constant are used. However, it is also possible to employ other setting elements such as hydraulic or pneumatic elements. The first treatment chamber 4 in accordance with the invention is a frieze or stuffer box, into which the yarn is fed and precompressed with the two first rotational bodies 3*a* and 3*b*. The two first rotational bodies 3*a* and 3*b* that is, the first roller pair, preferably guarantee an exact feed with maximum conveying speed. The two first rotational bodies have essentially flat contact surfaces in this embodiment, so that both rotational bodies contact each other in a line. Geometries deviating from this can also be selected for the two rotational bodies. In the treatment direction after the first treatment chamber 4 come two further rotational bodies 6*a* and 6*b*, whereby the curved arrows again show the rotational direction of these bodies. These two second rotational bodies 6*a* and 6*b* or the second roller pair 6a, 6b are used essentially to compress the yarn. In this embodiment the second roller pair 6*a* and 6*b*, in comparison to the first roller pair 3*a* and 3*b*, does not have a cylindrical surface, but rather a form deviating from it. The shaping of the roller pair 6*a* and 6*b*, together with the distance of the rotational axes, in which the rotational bodies 6*a* and 6*b* turn, is used for setting or adjusting to different yarn types.

The first treatment chamber 4 is, as noted above, a precompression chamber, with which essentially the frieze character of the yarn is determined. After the second rotational bodies 6*a* and 6*b* a second treatment chamber 10 follows the conveying route of the yarn. This second treatment chamber 10 is used for final compression of the yarn. The frieze character predetermined by the compression can be amplified by the supply of steam via the feed device 14.

In a preferred embodiment the two first rotational bodies 3*a* and 3*b* rotate with a speed essentially corresponding to the full speed of rotation and determine in this way the productive capacity. The second rotational bodies 6*a* and 6*b* rotate preferably essentially more slowly in comparison to this and guarantee in this way the object of compression and final shaping. By faster or slower rotation a greater or lesser circumferential speed is understood. A slow rotation of the second rotational bodies 6*a* and 6*b* could also be achieved by selecting a smaller diameter for this rotational body.

In this way for example different circumferential speeds could be achieved at the same angular velocity.

Through the special shaping of the second roller pair 6*a* and 6*b*, which deviates from the ideal shape of a cylinder, conveyor chambers or recesses 16 can come into being, which can hold and also transport a great volume of yarn. The individual recesses can have any geometric shapes, for example u-shaped, v-shaped, polygon-shaped, circular or elliptical shapes or blended forms of the same. Due to the ability of these recesses to hold great volumes of yarn, an essentially slower rotational speed of the second roller pair 6*a* and 6*b* is made possible, and in this way a higher compression pressure can be built up in the second chamber.

In this way it is possible to convey the yarn at a speed that is not constant.

In comparison to this in the first treatment chamber there is a comparably slower compression pressure. In this way the above mentioned shiners on the yarn, caused by the first rotational body, or stoppages caused by entanglements of the yarn can be avoided.

The degree of precompression can be changed by a changing of the first precompression chamber, that is for example an above mentioned change of area or a change of the differential speed between the two roller pairs 3*a* and 3*b* on the one hand and 6*a* and 6*b* on the other hand. Preferably this change can also occur automatically.

In a special embodiment a pressure sensor or the like can be provided within the first treatment chamber 4, which, in case a pressure that is too high is detected, adjusts the differential speed between the rotational motion of the first roller pair 3*a* and 3*b* and the second roller pair 6*a* and 6*b*, in this case reducing the difference to avoid too great of pressure on the first roller pair 3*a* and 3*b*. Instead of a pressure sensor, optical devices can also be provided, which determine the yarn density in the first treatment chamber 4.

In the same way in dependency on the signals output by a pressure sensor or by the optical devices the cross section of the first treatment chamber 4*a* could be enlarged. In this way an ideal adaptation of the cross section of the first treatment chambers and the difference of the speed of rotation of the two roller pairs 3*a* and 3*b* and 6*a* and 6*b* respectively can be achieved automatically.

Such an adaptation of the differential speed and of the cross section of the first treatment chamber allows a setting of the frieze character in greater bandwidth.

Further, the frieze character can also be influenced in the second treatment chamber 10. The final section 15 of the second treatment chamber can be changed with regard to its cross section. This occurs for example via contraction device 17*a* and 17*b*, which for example can be automatically controlled by control elements 18*a* and 18*b*.

Furthermore the multiplicity in variation in frieze character can be increased by adding saturated steam in one of the treatment chambers, in particular the second treatment chamber. In the process, make sure that the yarn does not come into direct contact with water in fluid form, particularly, but not exclusively, with condensation. Such direct contact with water would be noticeable for example in the form of color differences in the yarn.

Preferably the second treatment chamber 14 has a double-walled shape 12. In this way the second treatment chamber 10 will heat itself up separately essentially conditional on the treatment medium of steam. In this way all the elements in the second treatment chamber that are in contact with the yarn have the same temperature as the steam itself. In this way condensation and possibly insulation are essentially ruled out.

In a further preferred embodiment the second treatment chamber 10 is essentially conical in design, that is the space tapers to the second roller pair 6*a* and 6*b* and the space expands to the exit. Instead of a conical taper, however, a different type of taper, for example a graded taper, is also conceivable. In this way the yarn is compressed more strongly upon entry into the second treatment chamber 10 and in this way the escape of steam in the direction of the second two rotational bodies 6*a*, 6*b* is essentially prevented. The remaining steam essentially escapes at the end of the second treatment chamber 10 in the yarn's direction of movement and can be removed by suction at any point.

FIG. 4 shows the passing of the yarn through the first two rotational bodies 3*a* and 3*b*. These have rotational axes M1 and M2, which essentially coincide with the geometric center of the cross section. The reference symbols 31*a* and 31*b* designate the surfaces of the rotational bodies 3*a* and 3*b*.

The foundation of the resulting frieze character is laid when the yarn arrives in the first roller pair 3*a* and 3*b*, that is in FIG. 4 at Position A. It is particularly critical which space after the yarn is immediately available after the roller pair, that is in the direction of the arrow B of the plane m. The arriving yarn or several arriving threads can move only to the left or right along the roller curve of flight path, that is, in the figure from the plane of the blade out or into the plane of the blade. A movement to the left or the right, that is, from the plane of the blade out or into the plane of the blade, is only restricted by the presence of an adjacent thread or thread bundle. After the line of contact of the two rollers 3*a* and 3*b* free space comes into being during the conveying of the yarn.

The roller line of contact is the line of intersection which is formed from the plane m on the one hand and a second plane, which is fixed by the rotational axes of rollers 3*a* and 3*b* and the straight line connecting central points M1 and M2. A deflection of the thread or of the yarn in the figure toward the top or the bottom is prevented essentially by the roller contact surfaces 31*a* and 31*b*, in particular their properties.

This factual state is described more comprehensively in FIG. 5. As a result of this, the frieze character resulting from the geometry of the rollers, that is in particular the wide diameter of the rollers, is greatly influenced. An additional exertion of influence is also possible, to the effect that the rollers have a cross section deviating from the ideal cylinder shape, such as an elliptical form or the like.

Preferably it is further possible to unravel yarns or bundles of thread prior to the first roller pair 3*a*, 3*b*, for example into individual threads or groups of threads. Preferably a separating device 20 shown in FIG. 3 is used. This can have boreholes, a comb, eyelets or similar items.

A stronger frieze character can be achieved by means of unraveling the individual yarns. Preferably the individual threads of the yarn can be distributed essentially uniformly, that is at equal distances to each other, over the roller width of rollers 3*a* and 3*b*. If the threads are split up at constant roller width into thread bundles, which enter the precompression room distributed uniformly over the roller width, the more threads are combined into bundles, the greater the distance becomes from thread bundle to thread bundle.

This factual state is schematically represented in FIGS. 6 through 9. While in FIG. 6 the yarn is split up into individual threads, which run at a predetermined distance d1 to each other, in FIG. 7 two threads each were grouped into one double thread. In this case a distance d2 results between the respective thread groups. In FIG. 8 four threads each were combined into a group, resulting in a distance d3 between the two groups. In FIG. 9 finally all the threads were combined.

The bigger the bundles selected, that is, the more threads are consolidated into a bundle, the more space there is available to the individual bundle in cross direction, that is in FIG. 4 in the direction of the longitudinal direction of the rotational axes. In this way the typical frieze arches come into being, which are marked in FIGS. 6 through 8 with reference symbol 35.

In this way the strongest frieze character results when the individual bundles proceed at greater distances to each other. The weakest frieze character results when one lets all threads enter as one bundle, since in this case the bundle is given maximum freedom of movement. By means of splitting the yarn into more or fewer bundles influence can thus be further exerted on the resulting frieze character. In FIG. 6 through 9 the reference symbol e refers to the line in which the roller pair 3*a* and 3*b* come into contact with each other.

In summary the device for treating the yarns has a separating device or a yarn feed part 20, which can be in particular but not exclusively a mouthpiece with bore holes, which separates the individual threads. As mentioned above, other separating elements such as combs, eyelets etc. can also be used. The separating element is followed by a first roller pair 3*a*, 3*b*, a first treatment chamber 4, which has a cross section contraction device 9, a second roller pair, 6*b*, a second treatment chamber 10, which preferably has a steam perforation, and an additional cross section contraction device at the end of the second treatment chamber 6.

With the invention's method individual threads or grouped threads or yarn bundles are conveyed with the first roller pair 3*a* and 3*b* into the first treatment chamber in Position 4. In the first treatment chamber 4 the thread is given the embossing appearance. The first treatment chamber can be automatically set, in order to take different yarn materials into account. Subsequently the yarn is picked up by the second rotational bodies or the second roller pair 6*a* and 6*b* and fed into the second treatment chamber 10. In the process, the circumferential speed of the second roller pair 6*a* and 6*b*, as mentioned above, is significantly lower than that of the first roller pair 3*a* and 3*b* (ca. 1/10). With the second roller pair 6*a* and 6*b* the yarn is pressed in the second treatment chamber 10 at high pressure, where the yarn for the time being is given a permanent shape.

Subsequently in the second treatment chamber 10 the yarn is preferably admitted with saturated steam, which accelerates and favors the shaping process of the yarn.

At the exit of the second treatment chambers the cross section can preferably be automatically contracted. By means of this measure the counterpressure in the second treatment chamber 10 can be varied and in this way an additional influence can be exercised on the frieze character of the yarn. After the shaping in the device shown in FIG. 3 the yarn is fed to a (not shown) heat set in order to achieve a heat setting of the yarn.

By means of the proposed method the actual compression process and the effected dynamic pressure of the first roller pair 3*a* and 3*b* is at least partially taken away and assumed by the second roller pair 6*a* and 6*b*. In this way the yarn is essentially prevented from being damaged by the fast running first roller pair and in this way shiners and color differences can be prevented.

Along with that the operating safety of the system is increased and hangers are prevented, that is, engagement of the yarn with the quickly rotating rollers. Also yarn breakage can to a large extent be avoided by means of this method.

By means of the additionally proposed devices, such as for example the yarn feeding prior to the first roller pair, as well as the second roller pair 6*a* and 6*b* and the first treatment chamber 4 adjustable in cross section by these it is possible to manufacture the yarns known up to now purposefully and reproducibly. What is more, however, completely new yarn characters can also be created.

Along with that, more stable running features are achieved, which results in considerably fewer thread breaks, through which production can be increased and an improved efficiency can be achieved. The reduction of the production speed on the basis of the risk of a drawing in or rubbing of the yarns at the first roller pair 3*a*, 3*b* can be prevented with the help of the proposed device. Finally, with the proposed device it is not necessary to increase the rotation in the yarn during twisting or cupellation, which would lead to longer run times.

The invention claimed is:

1. An apparatus for texturing yarn, comprising:

(a) a yarn feeding assembly for delivering a yarn from a supply;

(b) a first yarn treatment chamber downstream from the yarn feeding assembly for receiving the yarn from the yarn feeding assembly, and comprising:

(i) a first yarn compression zone for applying a first compression force to the yarn; and (ii) a second yarn compression zone, comprising first and second opposed, rotationally-mounted, non-intersecting, non-contacting compression rollers for receiving the yarn from the first yarn compression zone, the first and second compression rollers each having a plurality of spaced recesses formed in respective outer surfaces, a one of the spaced recesses of the first roller cooperating with a radially-aligned recess of the second roller during rotation to collectively form successive yarn compression pockets that compress the yarn with a second compression force while simultaneously moving the yarn downstream;

(c) a second yarn treatment chamber for receiving the yarn from the first and second compression rollers and applying a further treatment thereto; and (d) a discharge assembly for allowing controlled, predetermined removal of the treated yarn from the second treatment chamber for downstream processing.

2. An apparatus for treating yarn according to claim 1, wherein the yarn feeding assembly comprises a pair of feed rollers.

3. An apparatus for treating yarn according to claim 1, wherein the second yarn treatment chamber includes a heater for applying heat to the yarn.

4. An apparatus for treating yarn according to claim 1, wherein the second yarn treatment chamber is adapted to further compress the yarn received from the first yarn treatment chamber.

5. An apparatus for treating yarn according to claim 1, wherein recesses of the first and second compression rollers comprise axially-extending valleys having a generally curved cross-section.

6. An apparatus for treating yarn according to claim 1, wherein the second yarn treatment chamber includes a steam injector for applying steam onto the yarn therein.

7. An apparatus for treating yarn according to claim 6, wherein the second yarn treatment chamber includes a double wall defining a steam reservoir within which the steam is contained for maintaining the temperature of an inner wall of the second yarn treatment chamber at the temperature of the steam for preventing condensation of the steam within the second yarn treatment chamber.

8. An apparatus for treating yarn according to claim 1, wherein the discharge assembly comprises a variable volume exit gate for controlling the rate at which the yarn exits the second yarn treatment chamber.

9. An apparatus for treating yarn according to claim 1, wherein the yarn feeding assembly includes a variable speed device for permitting the yarn to be delivered to the first yarn treatment chamber at varying rates.

10. An apparatus for treating yarn according to claim 1, wherein the second yarn treatment chamber includes a variable speed device for rotating the first and second compression rollers in unison at varying rates.

11. A method of texturing yarn, comprising:

(a) delivering a yarn from a supply to a first yarn treatment position;

(b) applying a first compression force to the yarn;

(c) providing a second yarn treatment position, including first and second opposed, rotationally-mounted, non-intersecting, non-contacting compression rollers for receiving the yarn from the first yarn treatment position, the first and second compression rollers each having a plurality of spaced recesses formed in respective outer surfaces, a one of the spaced recesses of the first roller cooperating with a radially-aligned one recess of the second roller during rotation to collectively form successive yarn compression pockets;

(d) compressing the yarn with a second compression force in the spaced recesses of the rotating first and second compression rollers while simultaneously moving the yarn downstream; and (e) receiving the yarn from the first and second compression rollers and applying a further treatment thereto.

12. A method according to claim 11, and including the step of applying heat to the yarn.

13. A method according to claim 11, wherein the step of applying a compression to the yarn includes the steps of applying a first compression to the yarn and then applying a second compression to the yarn.

14. A method according to claim 11, wherein the step of providing recesses in the first and second compression rollers comprises the step of providing axially-extending valleys having a generally curved cross-section.

15. A method according to claim 11, and including the step of applying steam onto the yarn.

16. A method according to claim 15, wherein the step of applying steam onto the yarn includes the step of maintaining the steam in a double wall defining a steam reservoir within which steam is contained for maintaining the temperature of an inner wall of a yarn treatment chamber at the temperature of the steam for preventing condensation.

17. A method according to claim 11, and including the step of controlling the rate at which yarn is allowed to move downstream.

18. A method according to claim 11, and including the step of delivering the yarn from the supply at varying rates.

19. A method according to claim 11, and including the step of rotating the first and second compression rollers in unison at varying rates.

* * * * *